United States Patent [19]

Lafon et al.

[11] Patent Number: 4,843,623

[45] Date of Patent: Jun. 27, 1989

[54] HEARING AID DEVICES IN WHICH HIGH FREQUENCY SIGNAL PORTIONS ARE TRANSPOSED IN LOW FREQUENCY COMPENSTION SIGNAL PORTIONS

[75] Inventors: Jean-Claude Lafon; Tijani Gharbi, both of Besancon, France

[73] Assignee: University De Franche-Comte, France

[21] Appl. No.: 53,298

[22] Filed: May 22, 1987

[30] Foreign Application Priority Data

May 23, 1986 [FR] France ..... 86 07408

[51] Int. Cl.[4] ..... H04R 25/00

[52] U.S. Cl. ..... 381/68.2

[58] Field of Search ..... 381/682, 68

[56] References Cited

U.S. PATENT DOCUMENTS 2,150,364 3/1939 Dudley ..... 381/68.2

3,385,937 5/1968 Lafon ..... 381/68.2

FOREIGN PATENT DOCUMENTS 0054450 7/1984 European Pat. Off. .

2577739 8/1986 France ..... 381/68

*Primary Examiner*—Jin F. Ng

*Assistant Examiner*—Danita R. Byrd

*Attorney, Agent, or Firm*—Townsend and Townsend

[57] ABSTRACT

The invention relates to a hearing aid device in which the slices ($s_1$, $x_2$) of the electrical signal corresponding to each acoustic signal comprised respectively between 1500 and 3500 Hz and between 5000 and 7000 Hz, are transposed into compensation signals ($S_1$, $S_2$) comprised within two coupled ranges of separate low frequencies above the range 60 to 800 Hz, alone preserved without compensation. To preserve the timbres of the transposed sounds, the compensation signals are obtained by multiplying each slice ($x_1$, $x_2$) by itself or by a signal ($x'_1$, $x'_2$) deduced from this slice by amplitude equalization.

6 Claims, 1 Drawing Sheet

HEARING AID DEVICES IN WHICH HIGH FREQUENCY SIGNAL PORTIONS ARE TRANSPOSED IN LOW FREQUENCY COMPENSTION SIGNAL PORTIONS

The invention relates to hearing aids intended for the deaf and in which the sounds emitted in one portion at least of the treble register, sounds normally inaudible to said deaf persons, are transposed into other "compensation" sounds situated in the audible bass range of the acoustic spectrum.

BACKGROUND AND SUMMARY OF THE INVENTION

Certain devices of the this type have been proposed by the patents France Nos. 1 382 916 and 2 494 988, and their equivalents U.S. Pat. No. 3,385,937 and European Patent Publication No. 54,450, respectively.

It is a particular object of the invention to render devices of the type concerned such that the sounds transposed by them into the bass range of the spectrum comprise information relating not only to the pitch and to the intensity of the sound signals to be perceived, but also the timbres or laryngeal components of these signals.

Accordingly, auditive prosthetic devices of the above type comprise still, in manner known in itself, transducer means to transform the acoustic signals to be processed into electrical signals, means for sampling at least one particular slice $x_i$ of order i of each of these electrical signals, with the slice being the frequency components comprised in a pre-determined range of high frequencies, that is to say corresponding to high-pitched sounds, frequencies comprised between $f_{i\ min}$ and $f_{i\ max}$, i being an integer comprised between 1 and 3 and increasing in the same direction as the frequencies of the slices concerned, means for elaborating from each of these slices $x_i$ a compensation signal $S_i$ comprised within a range of low frequencies, that is to say corresponding to bass sounds, frequencies comprised between $F_{i\ min}$ and $F_{i\ max}$, the bass ranges corresponding to the various compensation sounds $S_i$, being distinct from one another, means for adding together the different compensation signals $S_i$ thus elaborated and transducer means to transform the sum-signal so-obtained to a signal applicable to the deaf person to be treated so as to be perceptible by him.

According to the invention, the hearing aid devices so-defined are characterized in that the means for elaborating each compensation signal $S_i$ comprise means for multiplying the corresponding signal slice $x_i$ by a signal $x'_i$ which is either identical with this signal slice $x_i$ or deduced from the latter by amplitude equalization, so as to form a product-signal $X_i$, and means for sampling, in this product-signal $X_i$, by means of a band-pass filter, the portion of said product-signal of which the low frequency is comprised within the range of frequencies $F_{i\ min}$ to $F_{i\ max}$, which portion constitutes the desired compensation signal $S_i$.

Applicants have in fact discovered that the product-signals $X_i$ concerned comprise such portions at low frequency by reason of properties ascribable to the products of trigonometric lines.

It happens in fact that each of the signals $x_i$ can be decomposed into a Fourier series, that is to say into a multitude of sinusoidal components of the type $$a \cos 2\pi ft + b \sin 2\pi ft \quad (1)$$

in which formula a and b denote constants and f the oscillation frequency of the component concerned, said frequency being comprised between the two limits $f_{i\ min}$ and $f_{i\ max}$.

If one considers, in addition to the component which has just been defined, a second component comprised by the same signal $x_i$ and defined by the formula $$a' \cos 2\pi f't + b' \sin 2\pi f't \quad (2)$$

in which a' and b' denote also two constants and f', the frequency of this second component comprised like f between the two limits $f_{i\ min}$ and $f_{i\ max}$, and if one multiplies these two components by one another, the product shows not only terms in $\cos 2\pi\ (f+f')t$ and $\sin 2\pi\ (f+f')t$ but also terms in $\cos 2\pi\ (f-f')t$ and $\sin 2\pi\ (f-f')t$.

More generally, if the signal $x_i$ is multiplied by itself, the product signal $X_i$ shows sinusoidal components oscillating at almost all the frequencies of the type f-f' corresponding to differences of any two frequencies comprised within the range of $f_{i\ min}$ to $f_{i\ max}$.

Among the innumerable differences in frequency so-defined, a certain number necessarily occur within the ranges of low frequencies desired for the compensating bass sounds, and it is this which enables such bass sounds to be obtained, said sounds respecting wholly the temporal forms of the high-pitched sounds to be represented.

This respect for temporal forms enables the transposition towards the low notes not only of the high notes and intensities of the high-pitched slices sampled, but also their timbres, which increases considerably the intelligibility of the processed sounds.

In advantageous embodiments, recourse is had in addition to one and/or other of the following features:

the number n of the slices of signal $x_i$ at high frequency which are sampled in the electrical signals to be processed is equal to two, the first slice being comprised between 1500 and 3500 Hz and the second, between 5000 and 7000 Hz, in an arrangement according to the preceding paragraph, the ranges of low frequencies selected for the compensation sounds $S_1$ and $S_2$ are respectively from 800 to 1000 Hz and from 1050 to 1200 Hz, in an arrangement according to the the next-to-last paragraph, the ranges of low frequencies selected for the compensation sounds $S_1$ and $S_2$ are respectively from 800 to 1200 Hz and from 1250 to 1900 Hz.

The invention comprises, apart from these main features, certain other features which are preferably used at the same time and which will be more explicitly considered below.

BRIEF DESCRIPTION OF THE DRAWINGS

In the following, preferred embodiments of the invention will be described with reference to the accompanying drawing given of course as non-limiting.

DETAILED DESCRIPTION OF THE INVENTION AND PREFERRED EMBODIMENTS

Figure 1:
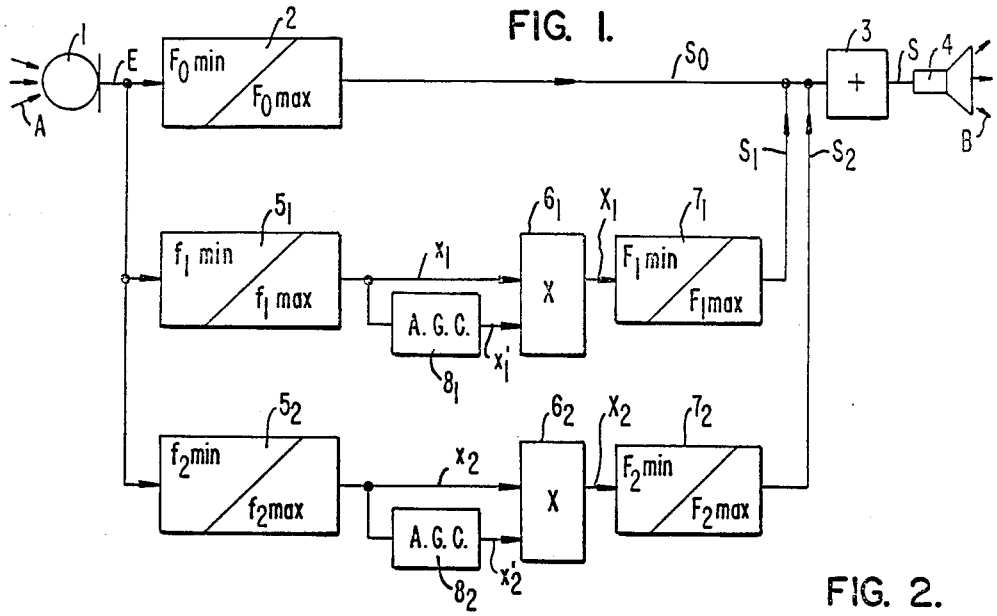
FIG. 1 of this drawing, is a diagram of a hearing aid device constructed according to the invention.

The device concerned comprises, in manner known in itself:

a microphone 1 adapted to transform each of the sound signals A that it receives into an electrical signal E whose amplitudes and frequencies are proportional to that of said signal A, a band-pass filter 2 allowing passage of all the portion $S_o$ of said signal E whose frequency is comprised between a first very low frequency $F_{o\ min}$ of the order of 60 Hz and a second frequency $F_{o\ max}$ which depends on the degree of deafness to be treated and which is generally comprised between 500 and 1200 Hz, being for example 800 Hz, n electrical channels $V_i$ mounted in parallel on the filter 2 and adapted to elaborate each an electrical compensation signal $S_i$, the number n being an integer comprised between 1 and 3 and the index i, an integer comprised between 1 and n, limits included, an adder 3 adapted to form the sum S of the signals $S_o$ and $S_i$, and a loud-speaker 4 adapted to transform the electrical signal S into a sound signal B which is employed in any desirable manner and in particular applied to the ear of a deaf person.

In a manner also known in itself, the channels $V_i$ each comprise:

a band-pass filter $5_i$ adapted to take up, in the electrical signal E, one slice $x_i$ of the treble spectrum inaudible to deaf people, the whole of these slices $x_i$ comprising the portions, of speech, which are most useful for the intelligibility of this speech, and means for elaborating compensation signals $S_i$, from these slices $x_i$, said signal being comprised respectively in the distinct ranges of low frequencies corresponding to sounds audible to the deaf person.

It is more particularly to these latter means of elaboration that the invention relates.

Said means comprise essentially, for each channel $V_i$:

a multiplier $6_i$ adapted to multiply the slice $x_i$ by itself or by a purified signal $x'_i$ obtained from $x_i$ by amplitude equalization, which gives a product-signal $X_i$, and a band-pass filter $7_i$ traversed by the only portion of the product-signal $X_i$, which is comprised between two low frequencies $F_{i\ min}$ and $F_{i\ max}$.

Each of these low frequencies is both greater than $F_{o\ max}$ and comprised within the range of frequencies audible to the deaf person to be treated.

In addition, preferably, there is each time selected $F_{i\ max} < F_{(i+1)\ min}$.

It is the outputs of the filters $7_i$ which constitute the desired compensation signals $S_i$.

The amplitude equalization indicated above consists of rendering equal to 1 the coefficients a, b, a' and b' of the above formulas (1) and (2).

It is obtained by causing amplifiers with a controlled gain (ACG) $8_1$, $8_2$ to be traversed by the signal slices $x_i$ to be purified.

Before being added to the signal $S_o$ in the adder 3, the compensation signals $S_i$ may be amplified so as to take into account the fact that the range of low frequencies which defines the band of filtering of each of them extends over only a small portion of the whole of the acoustic spectrum: thus the extent of said range is, for example, of the order of 200 to 500 Hz when the acoustic spectrum concerned is of the order of 8000 Hz.

The compensation signals $S_i$ elaborated by the multiplication and the filtering mentioned above can only be harmonics of the signals $x_i$ which have given rise to them.

They are hence synchronized time-wise with the latter and vary strictly as they do, and in the same time as the latter.

There is hence observed here an immediate transposition, in real time, of the sounds to be rendered intelligible, which has an important advantage over hearing appliances for which the treatment of the acoustic sounds received leads to the deferred emission of other sounds elaborated from at least one component of said sounds received.

In FIG. 1 it is assumed that the number n of channels $V_i$ is equal to two.

The high frequencies taken up from the two slices $x_1$ and $x_2$ are then advantageously comprised, respectively, within the range 1500 Hz ($f_{1\ min}$) to 3500 Hz ($f_{1\ max}$) and within the range 5000 Hz ($f_{2\ min}$) to 7000 Hz ($f_{2\ max}$).

As for the compensation sounds $S_1$ and $S_2$, they are, for example, comprised respectively within the range 800 Hz ($F_{1\ min}$) to 1000 Hz ($F_{1\ max}$) and within the range 1050 Hz ($F_{2\ min}$) to 1200 Hz ($F_{2\ max}$), which corresponds to a severe deafness in which the deaf person is only able to detect sounds whose frequency is less than 1200 Hz.

In a modification, applicable to a severe deafness, but less severe than the preceding one, the compensation sounds $S_1$ and $S_2$ are respectively comprised with in the range 800–1200 Hz and within the range 1250–1900 Hz.

Figure 2:
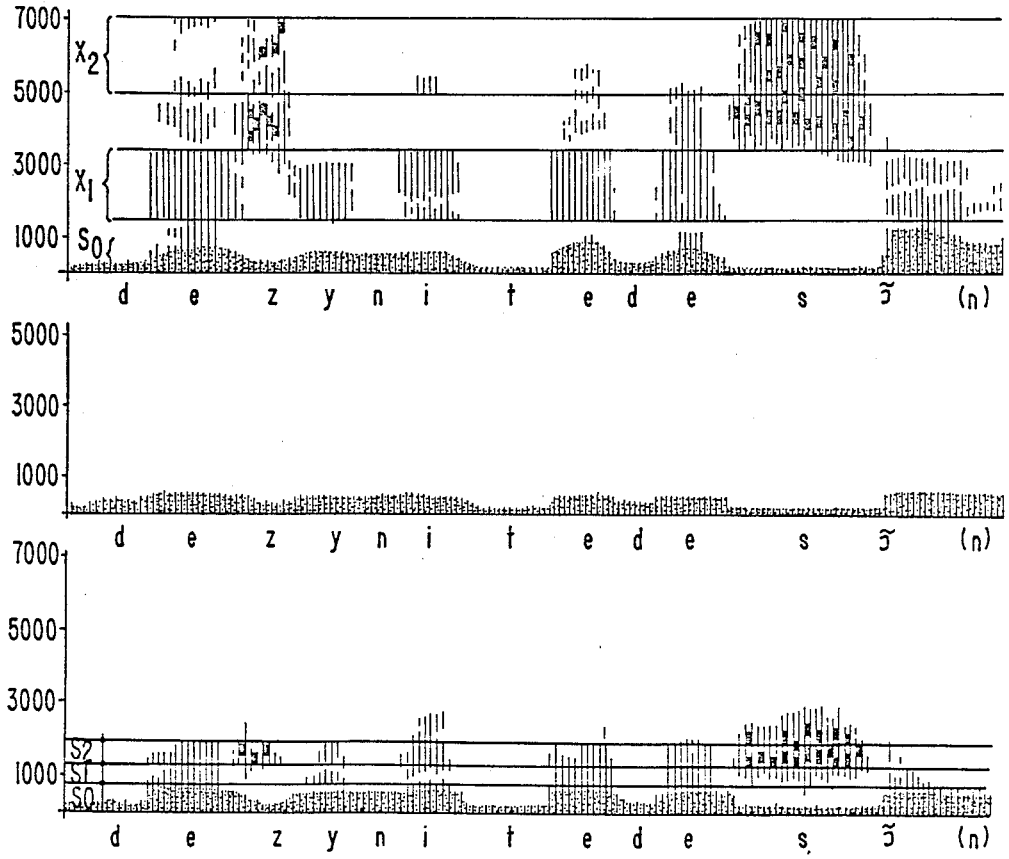
FIG. 2 is a triple sonagram enabling the advantage of the invention to be understood.

It is to this latter modification that the three comparative sonagrams of FIG. 2 correspond.

For each of these graphs, the frequency is plotted as ordinates and as abscissae are plotted the times corresponding to the emission of the phrase "des unites des sons".

The sonagram a at the top of FIG. 2 corresponds to normal hearing.

The middle sonagram b corresponds to what is heard by a very deaf person unequipped with a hearing aid, that is to say to the portion, of the acoustic message concerned, which is filtered above 800 Hz.

Finally the sonagram c at the bottom corresponds to what is heard by a patient afflicted with a severe deafness equipped with a hearing aid according to the invention.

The vertical streaks represent the transitory sounds of the laryngeal components of the sounds, or "timbres" of the sounds.

It is seen that the invention enables the incorporation with bass sounds reconstitued artificially and perceptible by the deaf person, not only of the "sibilant hisses" or high-pitched components of speech, corresponding particularly to the sounds of "z" or of "s", but also the timbres of the vowels.

As a result of which, and whatever the embodiment envisaged, a hearing appliance is obtained whose constitution, operation and advantages (in particular that of conferring automatically and instantaneously on the reconstituted bass artificial sounds the time characteristics or "timbres" of natural sounds to be perceived) emerges sufficiently from the foregoing.

As is self-evident and as results besides already from the foregoing, the invention is in no way limited to those of its types of application and embodiments which have been more especially envisages; it encompasses thereof, on the contrary all modifications, particularly those where the hearing aid devices concerned would be arranged so as to make correspond to each sound processed a signal still perceptible by the deaf person to be assisted, but not necessarily acoustic, in particular a pulse signal applicable to said deaf person in any desirable way perceptible by him, this application being for example effected electrically on his auditory nerve, or again mechanically on his skin by means of a suitable vibrator.

We claim:

1. Hearing aid device comprising transducer means for transforming the acoustic signals to be processed into electrical signals, means for sampling at least two preselected frequency ranges defined as slices, $x_i$, of the order i, of each of said electrical signals, each said slice defined by a predetermined range of high frequencies ranging from $f_{i\,min}$ to $f_{i\,max}$, i being an integer of 2 to 3 and increasing in the same direction as the frequencies of said slices, means for processing each of said slices $x_i$ to obtain a compensation signal $S_i$, each said compensation signal $S_i$ disposed within a range of low frequencies comprised between $F_{i\,min}$ and $F_{i\,max}$, said low frequency ranges corresponding to different compensation signals $S_i$ being distinct from one another, means for adding said compensation signals $S_i$ thus obtained to achieve a sum-signal, and transducer means for transforming said sum-signal into a signal applicable to the deaf person to be assisted so as to be perceptible by him, wherein said means for processing each compensation signal $S_i$ comprise means for multiplying the corresponding slice of signal $x_i$ by a signal $x'_i$ which is related to said slice $x_i$, so as to form a product-signal $X_i$, and means for sampling, in said product-signal $X_i$, by means of a band-pass filter, the portion of said product-signal whose low frequency is comprised within the frequency ranges $F_{i\,min}$ to $F_{i\,max}$, which portion constitutes the desired compensation signal $S_i$.

2. Hearing aid device according to claim 1, wherein the number of slices of signal $x_i$ at high frequency which are sampled from the electrical signals to be processed is equal to two, the first slice being comprised between 1500 and 3500 Hz and the second, between 5000 and 7000 Hz.

3. Hearing aid device according to claim 2, wherein the ranges of low frequencies selected for the compensation sounds $S_1$ and $S_2$ are respectively from 800 to 1000 Hz and from 1050 to 1200 Hz.

4. Hearing aid device according to claim 2, wherein the lower frequency ranges selected for the compensation sounds $S_1$ and $S_2$ are respectively 800 to 1200 Hz and 1250 to 1900 Hz.

5. Hearing aid device according to claim 1, wherein said signal $x'_i$ is identical to said slice of signal $x_i$.

6. Hearing aid device according to claim 1, wherin said signal $x'_i$ is deduced from said slice of signal $x_i$ by amplitude equalization.

* * * * *